United States Patent [19]

Tanikawa et al.

[11] 4,354,881

[45] Oct. 19, 1982

[54] METHOD FOR ANTIRUST TREATMENT OF STEEL STOCKS

[75] Inventors: Keiichi Tanikawa, Yokohama; Tatsurou Obi, Tokyo; Susumu Otsuka, Hikari; Isao Manabe, Tokushima; Akiyoshi Inubushi, Tokushima; Chiaki Maeda, Tokushima, all of Japan

[73] Assignee: Nippon Steel Corporation, Japan

[21] Appl. No.: 261,219

[22] PCT Filed: Oct. 22, 1980

[86] PCT No.: PCT/JP80 00254

§ 371 Date: May 5, 1981

§ 102(e) Date: May 5, 1981

[87] PCT Pub. No.: WO81/01157

PCT Pub. Date: Apr. 30, 1981

[30] Foreign Application Priority Data

Oct. 23, 1979 [JP] Japan ..... 54-136875

[51] Int. Cl.[3] ..... C23F 7/00

[52] U.S. Cl. ..... 148/6.14 R; 148/6.24

[58] Field of Search ..... 148/6.14 R, 6.14 A

[56] References Cited

U.S. PATENT DOCUMENTS 1,911,537 5/1933 Tanner ..... 148/6.14 R 3,895,170 7/1975 Tanaka ..... 428/457

FOREIGN PATENT DOCUMENTS 49-83639 8/1974 Japan .

53-27694 4/1978 Japan .

*Primary Examiner*—Ralph S. Kendall

*Attorney, Agent, or Firm*—Wenderoth, Lind & Ponack

[57] ABSTRACT

A steel stock such as hot-rolled pickled steel plate, cold-rolled steel plate, cast iron or the like is subjected to antirust treatment with an aqueous solution or an emulsion consisting mainly of a 1-hydroxybenzotriazole compound represented by the general formula:

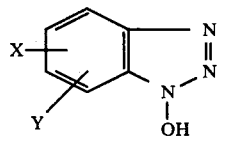

where X and Y represent hydrogen atoms and hydroxy, alkyl, carboxyl, nitro and sulfonic groups, and further containing one or more of aliphatic dicarboxylic acids added thereto, and having a pH within the range of 7–10.

3 Claims, No Drawings

METHOD FOR ANTIRUST TREATMENT OF STEEL STOCKS

TECHNICAL FIELD

The present invention relates to antirust treatment of steel stocks or materials such as hot-rolled pickled steel plate, cold-rolled steel plate, cast iron and so on.

BACKGROUND OF THE ART

Usually surface treatment is applied to the surface of cold-rolled steel plates, etc. for anticorrosion and preservation of fine appearance.

That is, because a considerable time passes before such various types of steel plates and so on are processed and used, they are coated with an antirust oil or chemically treated or are packed in vaporable antirust paper or are otherwise treated to prevent rust. Any of these prior art methods for anticorrosion, however, has the following drawbacks.

The application of antirust oil will incur, not to mention stickness of oil, the necessity for a degreasing step when the steel plates are in use, followed by the treatment of the exhausted degreasing solution, which is troublesome.

In addition, welding or like processing of materials with antirust oil applied thereto presents problems in that the electrodes become dirty, fuming becomes significant and the preservation of a good working circumstances is adversely affected.

Already publicly known water soluble antirust agents, for example, sodium nitrite, sodium borate, aromatic carboxylic acids, imidazoles, amines and surfactants are used alone or in combination. However, their antirust effect is useful mainly in water or in the air, and is rather poor when the steel plates contact one another in a wet atmosphere or under conditions where water is attached to them or when they are stacked at high temperature and high humidity, namely, in a wet box as specified by JIS Z-0228. Further, there are antirust agents with higher aliphatic amines or higher fatty acids incorporated therein. However, they also have drawbacks that their drying characteristics are bad and that a removal step is required as in the case of the use of antirust oil.

The inventors of the present invention have already discovered that 1-hydroxybenzotriazole has an excellent antirust effect for steel stocks as is described in Japanese patent publication No. 27694/78. However, it has been found that there is in this case a weakness that the discoloration or staining is produced in some cases if water is dropped on a treated steel plate, and another treated one is stacked thereon and allowed to stand at high temperature and high humidity atmosphere, although their antirust properties are very excellent after they are subjected to hot-air drying.

The present invention has overcome these drawbacks of the prior art methods and has further made it possible to exert an extremely good antirust effect without necessity for any further treatment in the subsequent steps.

DISCLOSURE OF THE INVENTION

In summary, the present invention is characterized by adjusting an aqueous solution of 1-hydroxybenzotriazole and an aliphatic dicarboxylic acid to within a neutral range with a neutralizing agent and applying the adjusted solution to the surface of metals to form an antirust coating.

The effects of the present invention are not limited to antirust ones in a particular environment. The antirust effects are excellent not only in water but also in the air, and in an acidic atmosphere or in an atmosphere of high temperature and high humidity where water droplets are present between the contacted treated steel plates or in other various environments where a temper rolling solution is scattered or its vapor attaches as water droplets on steel plates rolled in a high speed temper rolling step.

According to the present invention, a mixed aqueous solution consisting mainly of a 1-hydroxybenzotriazole compound represented by the general formula:

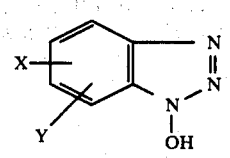

Where X and Y represent hydrogen atoms and hydroxy, alkyl, carboxyl, nitro and sulfonic groups, and containing simultaneously an aliphatic dicarboxylic acid, for example, one or more of suberic acid, azelaic acid and brassylic acid, is neutralized with ammonia water, hydrazine or an alkanol amine such as monoethanol amine or triethanol amine to provide an aqueous solution having a pH within the range of 7–10 which is applied to steel stocks. The aqueous solution may be used after a water-soluble high molecular compound or a surfactant is added thereto. Further, the object may be attained by applying to the surface of steel stocks a solution obtained by adding the mixed aqueous solution to an emulsion such as an aqueous mixture of cutting oil, abrasive oil or rolling oil, whereby an antirust coating is formed. In this instance, the concentration of the 1-hydroxybenzotriazole of the above general formula and its derivatives contained in the resulting solution is within the range of 0.01–10% (% used herein is by weight), and the aliphatic dicarboxylic acid added thereto may be employed within the range of 0.01–5%. Particularly preferably, each of the 1-hydroxybenzotriazole, main component, and the aliphatic dicarboxylic acid, additive, is used in the range of 0.1–2% from the standpoint of the antirust and economic aspects. Further, a proportion of 0.001–0.5% for the surfactant if added and a proportion of 0.01–2% for the high molecular compound if added are preferred from viewpoints of antirust and uniformity of the resulting coating, which will contribute to the enhancement of the anticorrosive properties.

It is a characteristic feature of the present invention that direct painting or direct plating is possible to the surface of steel stocks treated according to the present invention, which exerts effects equivalent to those of cases where painting or plating is applied to the surface of metals not subjected to any treatment.

BEST MODE FOR CARRYING OUT THE INVENTION

Hereunder, there are given examples of the present invention.

EXAMPLE 1

An aqueous solution containing 0.5% of 1-hydroxybenzotriazole and 0.3% of azelaic acid was adjusted to pH 8 by the addition of monoethanol amine as the neutralizing agent to give a treating solution. A steel material was subjected to the conventional temper rolling, and water was purposely applied to a part of the steel material at the exit, which was coiled as it was.

EXAMPLE 2

An aqueous solution prepared by adding 0.2% azelaic acid and further 0.03% of a nonionic surfactant (a polyoxyethylene alkyl ether) to 0.4% of 1-hydroxybenzotriazole is adjusted to pH 8 by the addition of monoethanol amine as the neutralizing agent to give a treating solution. This treating solution is sprayed continuously over a surface-cleaned cold-rolled steel plate. Immediately thereafter, the plate is treated with rubber rolls and dried with a drier.

EXAMPLE 3

An aqueous solution prepared by adding 0.3% of sebacic acid and 0.1% of an acrylic resin, a water-soluble high molecular material, to 0.4% of 1-hydroxybenzotriazole is adjusted to pH 8 by the addition of triethanolamine as the neutralizing agent to prepare a treating solution. This treating solution is sprayed continuously over a surface-cleaned cold-rolled steel plate, and immediately the plate is treated by rubber rolls and dried with a drier.

The results of antirust tests using steel plates treated according to the above method of the present invention and controls are shown in Table 1, and the results of direct painting, in Table 2.

EXAMPLE 4

An aqueous solution, prepared by adding 0.2% of sebacic acid and 0.03% of a nonionic surfactant (a polyoxyethylene alkyl ether) to 0.5% of 1-hydroxybenzotriazole, is adjusted to pH 9.0 by the addition of monoethanolamine as the neutralizing agent to give a treating solution. It is sprayed continuously over a surface-cleaned cold-rolled steel plate. Immediately thereafter, the plate is treated with rubber rolls and dried with a drier.

TABLE 1

| | Results of antirust tests | | | | |
|---|---|---|---|---|---|
| | Housing test in wet box* | | | | |
| | Stacking condition | Stacked after dropping of treating solution (1) | Stacked after dropping of tap water (2) | Indoor exposure for 10 days | In 0.6 N HCl atmosphere for 24 hours (3) |
| Present invention | | | | | |
| Example 1 | Coiled and allowed to stand in plant for 1 month | — | — | ◎ | ◎ |
| Example 2 | ◎ | ◎ | ◎ | ◎ | ◎ |
| Example 3 | ◎ | ◎ | ◎ | ◎ | ◎ |
| Example 4 | ◎ | ◎ | ◎ | ◎ | ◎ |
| Controls** | | | | | |
| Ammonium sebacate | ○ | ○ | Δ | X | X |
| Triethanol amine azelate | ○ | ○ | Δ | X | X |
| 1-hydroxybenzotriazole ammonium | ◎ | ◎ | Δ ~ | ○ | ○ |
| Commercially available product A | ○ | ○ | Δ | X | X |
| No treatment | XX | — | XXX | XX | XXX |

In the table,

*Ten test pieces of 10 × 10 cm subjected to a seven day housing test in a wet box (50° C., 98% RH) were bound tightly by the use of a miniature vise and then subjected to the tests.

**The concentration of all the treating solutions used as the controls was 1%, and the treatment using them was made by the same procedures as in the case according to the present invention.

(1): The aqueous treating solution was dropped on the treated steel plates, and the treated steel plates were stacked for the tests. Discoloration and rust condition of the portions on which the solution was dropped were evaluated.

(2): Tap water was dropped on the treated steel plates, and the treated steel plates were stacked and tested. Rust condition of the portions on which the water was dropped was evaluated.

(3): In the bottom of a desiccator, there was placed a 0.6 N aqueous HCl solution, and the treated steel plates were placed on a perforated plate in the desiccator by the capping. Rust condition after 24 hours was evaluated.

(4): The commercially available product A was of sodium nitrite system. Evaluations: ◎ . . . No change; ○ . . . Slight discoloration; Δ . . . Rust is noticeable; X . . . About 10% rust; XX . . . About 30% rust; XXX . . . More than 60% rust.

TABLE 2

| | Direct painting properties | |
|---|---|---|
| | Primary adhesion properties(1) | Secondary adhesion properties(2) |
| Treated steel plates in Examples 1–3 of | 10 | 10 |

TABLE 2-continued

| | Direct painting properties | |
|---|---|---|
| | Primary adhesion properties(1) | Secondary adhesion properties(2) |
| the present invention | | |
| Material treated with commercially available product A | 9 | 7 |
| Untreated material | 10 | 10 |

Paints used . . . Acrylic and epoxyurea paints (1)Cross-cut Ericksen 7 mm, unit 2 mm. The coating was peeled off by the cellophane tape, and the evaluation was made on the basis of ease of peeling.

(2)Adhesion properties of the coating were tested immediately after the sample used in the primary adhesion test was immersed in deionized water at 40° C. for 24 hrs. The test items are the same as in the primary adhesion test.

Evaluations: 10 (Excellent)-0 (Failure)

AVAILABILITY IN INDUSTRY

Thus, according to the present invention, not only the intended antirust effects can be fully displayed in various surrounding conditions but also no work in removing the anticorrosive agent before the next step is necessary, and painting or other required treatments may be conducted directly, so the workability can be improved. Further, a problem of toxicity resulting from the treatment has recently arisen in the case of the conventional treatment involving the use of sodium nitrite, whereas in case of the present invention, such toxicity is extremely low, and in the welding or like operations, there is no environmental pollution caused by fuming, nor any lowering of workability caused by staining of the electrodes. Thus, the present invention has excellent advantages as compared with the conventional surface treatment methods.

We claim:

1. A method for antirust treatment of steel stock which comprises treating the steel stock with an aqueous solution or an emulsion containing 0.01–10% by weight of a 1-hydroxybenzotriazole compound represented by the general formula:

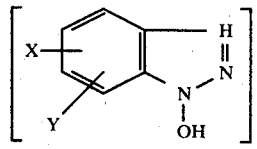

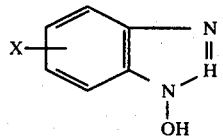

where X and Y represent hydrogen atoms, hydroxy, alkyl, carboxyl, nitro or sulfonic groups, and further containing 0.01–5% by weight of one or more of $C_8$–$C_{13}$ dialkanoic acids, and having a pH within the range of 7–10.

2. The method according to claim 1 wherein said dialkanoic acid is suberic, azelaic, sebacic or brassylic acid.

3. The method according to claim 2 wherein said dialkanoic acid is azelaic or sebacic acid.

* * * * *

UNITED STATES PATENT AND TRADEMARK OFFICE

CERTIFICATE OF CORRECTION

PATENT NO. : 4,354,881

DATED : October 19, 1982

INVENTOR(S) : Keiichi TANIKAWA, Tatsurou OBI, Susumu OTSUKA, Isao MANABE, Akiyoshi INUBUSHI, Chiaki MAEDA It is certified that error appears in the above—identified patent and that said Letters Patent is hereby corrected as shown below:

On the title page:

Item [73], correct the Assignee's name as follows:

NIPPON STEEL CORPORATION, Japan and

OTSUKA CHEMICAL COMPANY, LIMITED, Japan.

Column 4, lines 5 to 9, cancel and insert after column 4, line 19.

Column 4, Table 1, seventh entry under heading "Stacked After Dropping of Tap Water (2)", after "△~" insert -- ○ --.

UNITED STATES PATENT AND TRADEMARK OFFICE

CERTIFICATE OF CORRECTION

PATENT NO. : 4,354,881 Page 2 of 2

DATED : October 19, 1982

INVENTOR(S) : Keiichi TANIKAWA, Tatsurou OBI, Susumu OTSUKA, Isao MANABE, Akiyoshi INUBUSHI, Chiaki MAEDA It is certified that error appears in the above—identified patent and that said Letters Patent is hereby corrected as shown below:

IN THE CLAIMS:

Claim 1, rewrite the formula as follows:

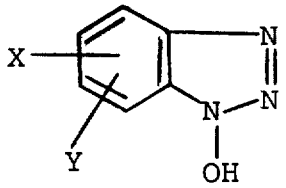

Signed and Sealed this

Tenth Day of January 1984

[SEAL]

Attest:

GERALD J. MOSSINGHOFF

Attesting Officer

Commissioner of Patents and Trademarks